US007209098B2

(12) United States Patent
Yamauchi et al.

(10) Patent No.: US 7,209,098 B2
(45) Date of Patent: Apr. 24, 2007

(54) PLASMA DISPLAY PANEL AGING METHOD AND AGING DEVICE

(75) Inventors: Masaaki Yamauchi, Osaka (JP); Takashi Aoki, Osaka (JP); Koji Akiyama, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 382 days.

(21) Appl. No.: 10/517,065

(22) PCT Filed: Apr. 14, 2004

(86) PCT No.: PCT/JP2004/005284

§ 371 (c)(1),
(2), (4) Date: Dec. 3, 2004

(87) PCT Pub. No.: WO2004/093118

PCT Pub. Date: Oct. 28, 2004

(65) Prior Publication Data

US 2005/0159069 A1 Jul. 21, 2005

(30) Foreign Application Priority Data

Apr. 18, 2003 (JP) ..... 2003-113873

(51) Int. Cl.
*G09G 3/28* (2006.01)
*G09G 3/20* (2006.01)

(52) U.S. Cl. ..... 345/60; 313/582

(58) Field of Classification Search ..... 345/60, 345/62, 63, 66–70; 313/582–584; 315/169.4; 445/6, 24, 62
See application file for complete search history.

(56) References Cited

U.S. PATENT DOCUMENTS

2005/0162085 A1* 7/2005 Yamauchi et al. ..... 313/583
2005/0215159 A1* 9/2005 Yamauchi et al. ..... 445/6
2006/0166585 A1* 7/2006 Akiyama et al. ..... 445/24

FOREIGN PATENT DOCUMENTS

JP 7-226162 8/1995
JP 9-251841 9/1997
JP 2002-197977 7/2002

* cited by examiner

*Primary Examiner*—Dennis-Doon Chow
(74) *Attorney, Agent, or Firm*—Wenderoth, Lind & Ponack, L.L.P.

(57) ABSTRACT

When aging is performed by applying aging voltage to a data electrode, a scan electrode, and a sustain electrode via respective inductors (301, 401, 302, 402, 303, 403) coupled to the electrodes, frequency of a ringing waveform included in an aging voltage waveform applied to the data electrode is set in a range of ½ to 2 times frequency of a ringing waveform included in an aging voltage waveform applied to the scan electrode. With the method above, the time required for aging is significantly shortened, and the aging with high efficiency in electric power is realized. Instead of using inductors (301, 302, 303) including a coil, controlling the length of lead wires (401, 402, 403) can also obtain desired inductance.

12 Claims, 6 Drawing Sheets

PLASMA DISPLAY PANEL AGING METHOD AND AGING DEVICE

TECHNICAL FIELD

The present invention relates to an aging method and an aging apparatus in a manufacturing process of a plasma display panel.

BACKGROUND ART

A plasma display panel (hereinafter referred to as "PDP" or "panel") is a display device that has a large screen, is thin and light, and has high visibility. As a discharge method of the PDP, an alternating current (AC) type or a direct current (DC) type can be employed. As an electrode structure, a surface discharge type or a counter discharge type can be employed. However, an AC surface discharge type PDP, in which the AC type discharge method and the surface discharge type electrode structure are employed, has presently become main stream. That is because the AC surface discharge type PDP is adequate to be fined and is easily manufactured.

The AC surface discharge type PDP generally has many discharge cells between a front substrate and a back substrate that are faced to each other. In the front substrate, a plurality of pairs of scan electrodes and sustain electrodes are formed in parallel on a front glass sheet, and function as display electrodes. A dielectric layer and a protective layer are formed so as to cover the display electrodes. In the back substrate, a plurality of data electrodes are formed in parallel on a back glass sheet, and a dielectric layer is formed so as to cover the data electrodes. A plurality of barrier ribs are formed on the latter dielectric layer in parallel with the data electrodes, and phosphor layers are formed on the surface of the dielectric layer and on side surfaces of the barrier ribs. The front substrate and back substrate are faced to each other so that the display electrodes and the data electrodes three-dimensionally intersect, and are sealed, and discharge gas is filled into a discharge space in the sealed product.

The PDP assembled in this method generally has a high charge starting voltage and discharges electricity unstably, so that aging is performed in a panel manufacturing process to uniform and stabilize the discharge characteristic.

In this aging method, rectangular waves having an opposite phase are applied as alternate voltage to the display electrodes, namely scan electrodes and sustain electrodes, for a long time. For shortening the aging duration, the following methods are proposed:

- a method of applying rectangular waves to the scan electrodes and the sustain electrodes via an inductor, for example, (Japanese Patent Unexamined Publication No. H7-226162);
- a method of applying rectangular waves having an opposite phase to the display electrodes, applying waves having the same phase as voltage waveform applied to the sustain electrodes to the data electrodes, and actively starting discharge between the scan electrode and the data electrode simultaneously with discharge between the display electrodes (Japanese Patent Unexamined Publication No. H9-251841, and Japanese Patent Unexamined Publication No. 2002-231141).

Even in the aging method discussed above, however, it takes 10 hours to stabilize discharge. Therefore, power consumption in the aging process extremely rises, and the rising becomes one cause of increasing the manufacturing cost of the PDP. The aging process takes the long time, so that there are various problems related to the site area of the factory and an environment in manufacturing such as an air conditioner. These problems will apparently become further serious in response to future enlargement of the screen of the PDP, increase in luminance, and increase in production amount.

The present invention addresses the problems, and provides an aging method and an aging apparatus that largely reduce aging duration and have high power efficiency.

DISCLOSURE OF THE INVENTION

In an aging method of a plasma display panel, the aging is performed by applying aging voltage to a scan electrode, a sustain electrode, and a data electrode via respective inductors connected to them. During the aging, frequency of the ringing waveform of the aging voltage applied to the data electrode is set at ½ to 2 times higher than that of the ringing waveform of the aging voltage applied to the scan electrode.

DETAILED DESCRIPTION OF PREFERRED EMBODIMENTS

An aging method in accordance with an exemplary embodiment of the present invention will be described hereinafter with reference to the following drawings.

Exemplary Embodiment

Figure 1:
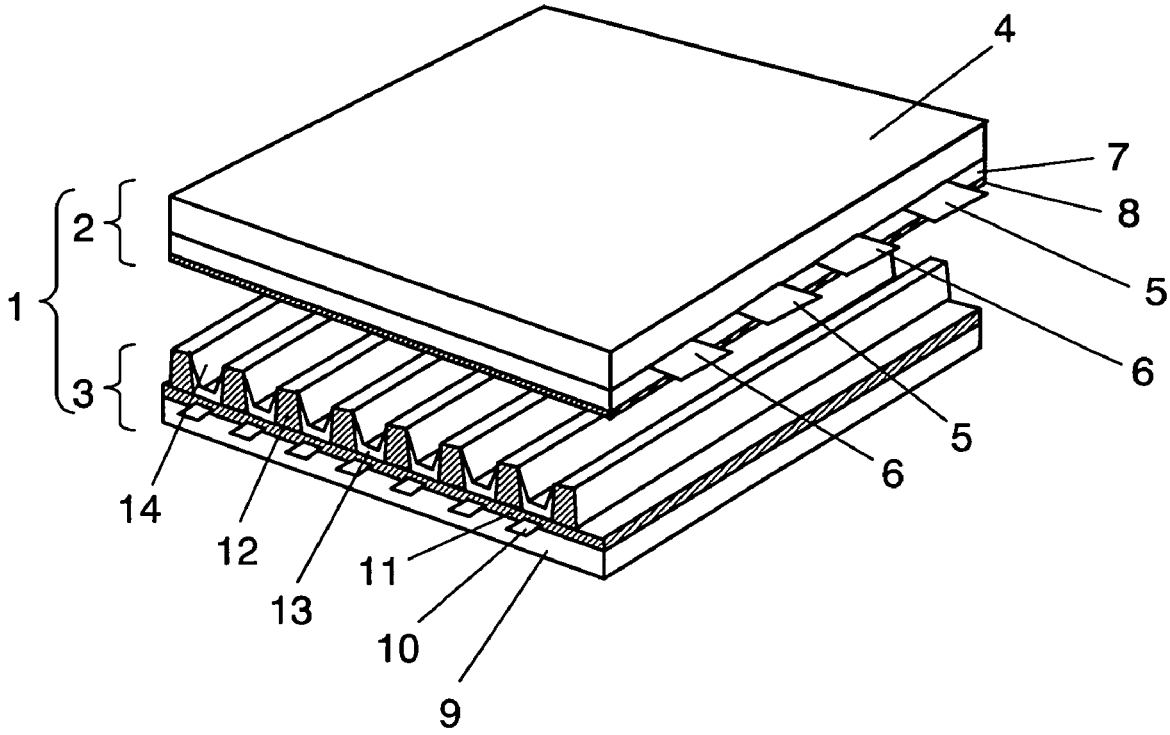
FIG. 1 is an exploded perspective view showing one example of a panel structure to be aged in accordance with an exemplary embodiment of the present invention.

FIG. 1 is an exploded perspective view showing one example of a panel structure to be aged in accordance with the exemplary embodiment of the present invention. Panel 1 has front substrate 2 and back substrate 3 that are faced to each other. In front substrate 2, a plurality of pairs of parallel scan electrodes 5 and sustain electrodes 6, which function as display electrodes, are formed on front glass sheet 4. Dielectric layer 7 is formed so as to cover scan electrodes 5 and sustain electrodes 6, and protective layer 8 is formed so as to cover the surface of dielectric layer 7. In back substrate 3, a plurality of data electrodes 10 are formed in parallel on back glass sheet 9, and base layer 11 is formed so as to cover data electrodes 10. A plurality of barrier ribs 12 are formed on base layer 11 in parallel with data electrodes 10, and phosphor layers 13 are formed on the surface of base layer 11 and on side surfaces of barrier ribs 12. Discharge gas is filled into discharge spaces 14 sandwiched between front substrate 2 and back substrate 3.

Figure 2:
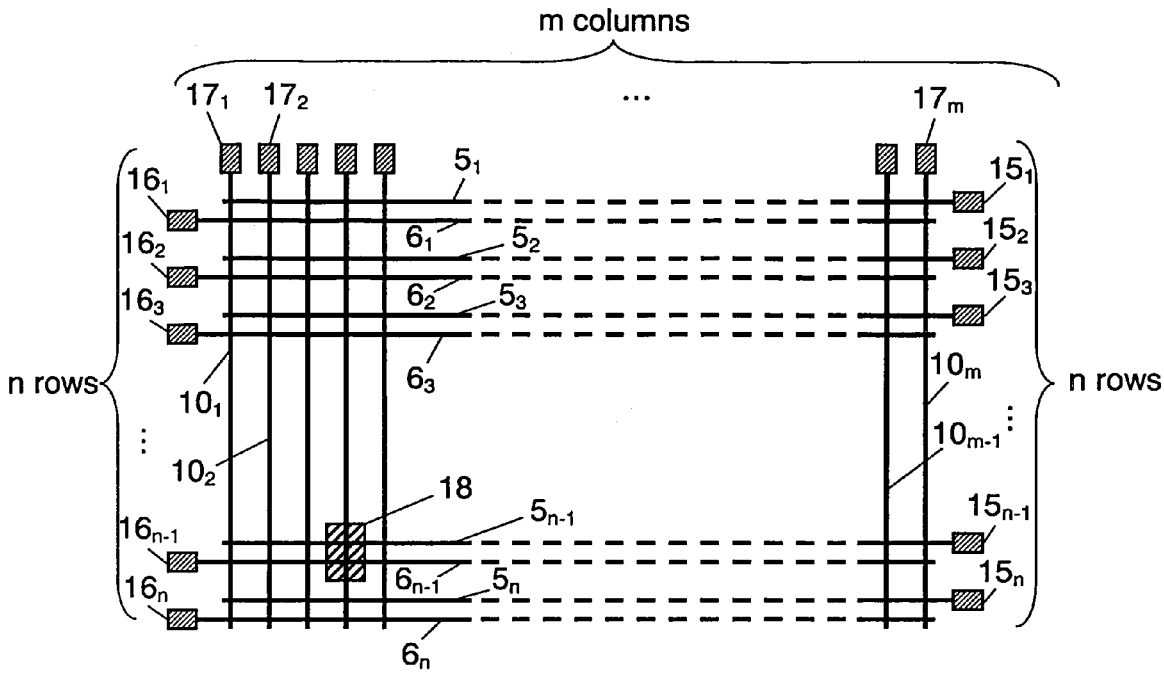
FIG. 2 is an array diagram of electrodes of the panel.

FIG. 2 is an array diagram of electrodes of panel 1. In the column direction, m columns of data electrodes $\mathbf{10}_1$ to $\mathbf{10}_m$ (data electrodes 10 in FIG. 1) are arranged. In the row direction, n rows of scan electrodes $\mathbf{5}_1$ to $\mathbf{5}_n$ (scan electrodes 5 in FIG. 1) and n rows of sustain electrodes $\mathbf{6}_1$ to $\mathbf{6}_n$ (sustain electrodes 6 in FIG. 1) are arranged. A discharge cell 18 is formed in a part where one pair of scan electrode $\mathbf{5}_i$ and sustain electrode $\mathbf{6}_i$ (i=1 to n) three-dimensionally cross one data electrode $\mathbf{10}_j$ (j=1 to m). Total number of discharge cells 18 formed in the discharge spaces is m×n. Scan electrode $\mathbf{5}_i$ is connected to scan electrode terminal $\mathbf{15}_i$ disposed in a periphery of the panel. Similarly, sustain electrode $\mathbf{6}_i$ is connected to sustain electrode terminal $\mathbf{16}_i$, and data electrode $\mathbf{10}_j$ is connected to data electrode terminal $\mathbf{17}_j$.

Figure 3:
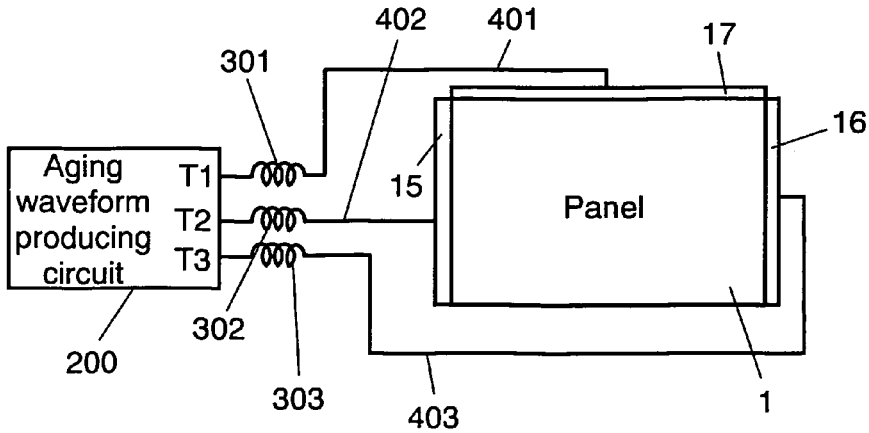
FIG. 3 is a block diagram of an aging apparatus using an aging method in accordance with the exemplary embodiment of the present invention.

FIG. 3 is a block diagram of an aging apparatus using the aging method in accordance with the exemplary embodiment of the present invention. The aging apparatus has the following elements:

aging waveform producing circuit 200 for producing aging voltage to be applied to panel 1;

a first inductor (inductor 301 and lead wire 401 for wiring) for connecting data electrode terminal 17 to output terminal T1 of a switching element (not shown in FIG. 3) for data electrodes that outputs pulse voltage for data electrodes of aging waveform producing circuit 200;

a second inductor (inductor 302 and lead wire 402 for wiring) for connecting scan electrode terminal 15 to output terminal T2 of a switching element (not shown in FIG. 3) for scan electrodes that outputs pulse voltage for scan electrodes of aging waveform producing circuit 200; and a third inductor (inductor 303 and lead wire 403 for wiring) for connecting sustain electrode terminal 16 to output terminal T3 of a switching element (not shown in FIG. 3) for sustain electrodes that outputs pulse voltage for sustain electrodes of aging waveform producing circuit 200. In other words, the first inductor is connected to data electrodes 10, the second inductor is connected to scan electrodes 5, and the third inductor is connected to sustain electrodes 6. Aging voltage is applied to each electrode via each of first through third inductors connected to the electrode.

The switching element for each kind of electrodes of aging waveform producing circuit 200 is generally formed of an insulated gate bipolar transistor (IGBT) and a field effect transistor (FET). Each of inductors 301, 302 and 303 is formed of a coil and a ferrite core.

In the present embodiment, the inductance (second inductance Lsc) of the second inductor is set at about 1 μH. Here, this inductance is a combined inductance of inductor 302 and lead wire 402 connected to it in series. The inductance (third inductance Lss) of the third inductor, namely a combined inductance of inductor 303 and lead wire 403 connected to it in series, is also set at about 1 μH. The inductance (first inductance Ld) of the first inductor, namely a combined inductance of inductor 301 and lead wire 401 connected to it in series, is set larger than each of second inductance Lsc and third inductance Lss.

In the present embodiment, first inductance Ld is set about 1.5 times larger than third inductance Lss. At this time, ringing frequency of the aging voltage waveform applied to data electrode terminal 17 is substantially equal to that of the aging voltage waveform applied to scan electrode terminal 15. For equalizing ringing phases in data electrode terminal 17 and scan electrode terminal 15, the aging voltage waveform of aging waveform producing circuit 200 is designed. According to an experiment, the aging can be performed in about ⅓ of the duration taken in the conventional aging method.

Figure 4:
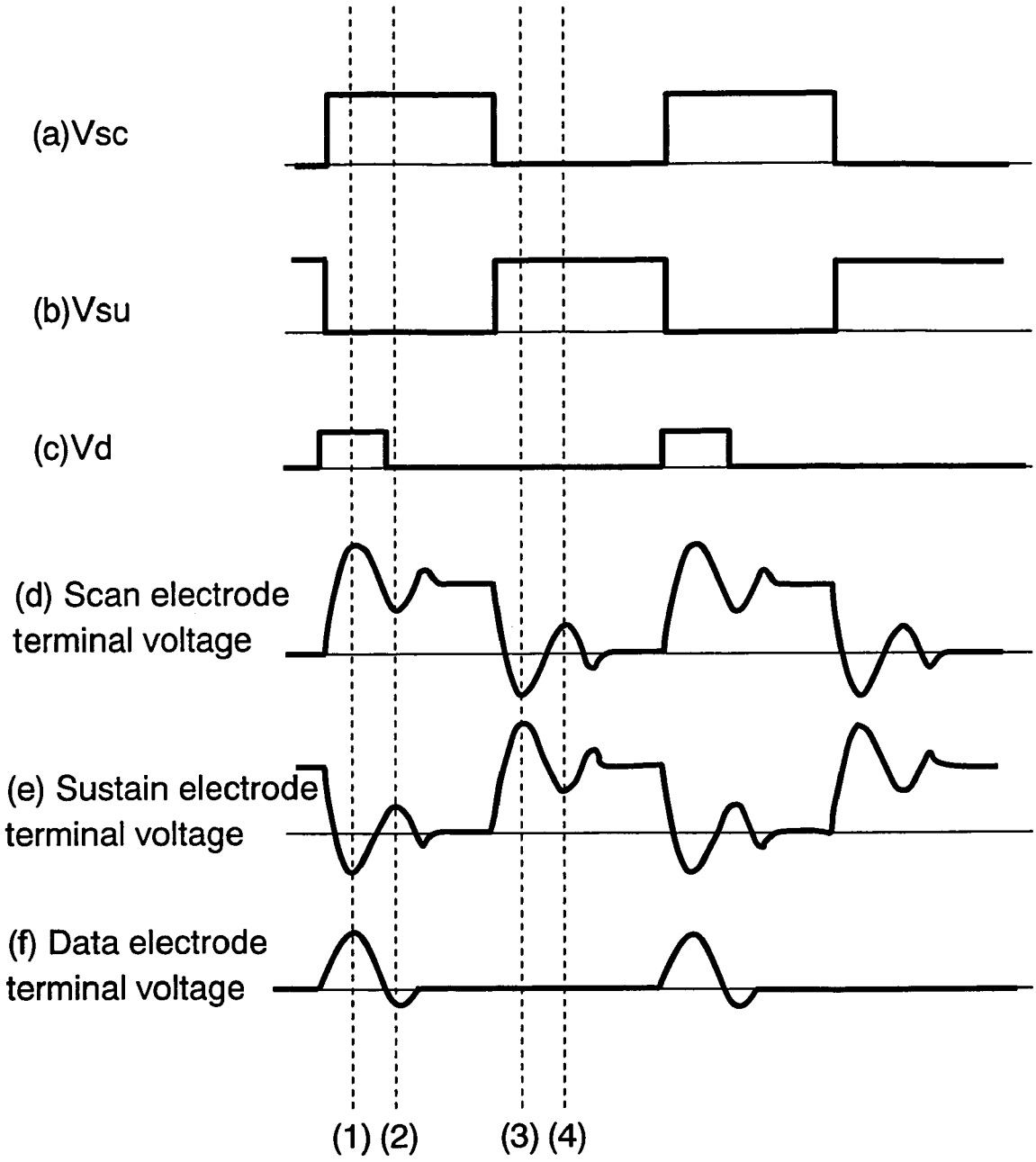
FIG. 4 shows waveform charts of aging voltages in the aging method in accordance with the exemplary embodiment.

The reason why the aging duration can be reduced by the aging method of the present embodiment of the present invention is described hereinafter. FIG. 4 shows waveform charts of aging voltages in the aging method in accordance with the exemplary embodiment. FIGS. 4(*a*), (*b*) and (*c*) show respective examples of voltage waveforms Vsc, Vsu and Vd in output terminals T2, T3 and T1 of respective switching elements of aging waveform producing circuit 200. Rectangular voltages Vsc and Vsu having mutually opposite phase are applied as aging voltages to scan electrodes 5 and sustain electrodes 6, respectively. Rectangular voltage Vd is applied to data electrodes 10. FIGS. 4 (*d*), (*e*) and (*f*) show voltage waveforms in scan electrode terminal 15, sustain electrode terminal 16, and data electrode terminal 17 of panel 1. As shown in FIG. 4, even when the voltage waveforms in output terminals T1, T2 and T3 of respective switching elements of aging waveform producing circuit 200 are rectangular, ringing is overlaid on the voltage waveforms in scan electrode terminal 15, sustain electrode terminal 16, and data electrode terminal 17 of panel 1, and these voltage waveforms become waveforms including ringing voltage waveforms. That is because electrostatic capacity of panel 1 and inductances of inductors 301, 302 and 303 and lead wires 401, 402 and 403 cause inductance-capacitance (LC) resonance. The electrostatic capacity of panel 1 and inductances of lead wires 401, 402 and 403 cannot be set at zero, so that overlaying of the ringing on the voltage waveforms in electrode terminals 15, 16 and 17 cannot be avoided.

In FIG. 4, large aging discharge occurs at timing (1) when large potential difference arises between scan electrode 5 and sustain electrode 6. At timing (2) after timing (1), the voltages are reversed by ringing. Even when the potential difference is too small to cause the discharge between scan electrode 5 and sustain electrode 6, discharge between scan electrode 5 and data electrode 10 can be induced because discharge starting voltage between them is low. When the latter discharge occurs, a priming effect accompanying this discharge substantially decreases discharge starting voltage between scan electrode 5 and sustain electrode 6 to cause discharge between scan electrode 5 and sustain electrode 6. This discharge is called erasing discharge hereinafter.

The investors studied the erasing discharge caused by aging discharge, and found the following phenomenon. The erasing discharge is caused by low applied voltage though the discharge consumes power, so that the aging effect is small, wall charge in a discharge cell is reduced, high voltage is therefore required for causing the next aging discharge (discharge at timing (3)), and the aging efficiency is finally reduced. The intensity of the erasing discharge largely depends on the characteristic of the discharge cell. For suppressing progression of the aging of a discharge cell that is apt to cause the erasing discharge and for sufficiently aging all discharge cells, longer aging duration is required. After the aging discharge at timing (3), erasing discharge is caused at timing (4) by voltage reversing by the ringing, similarly to the erasing discharge at timing (2).

Figure 5:
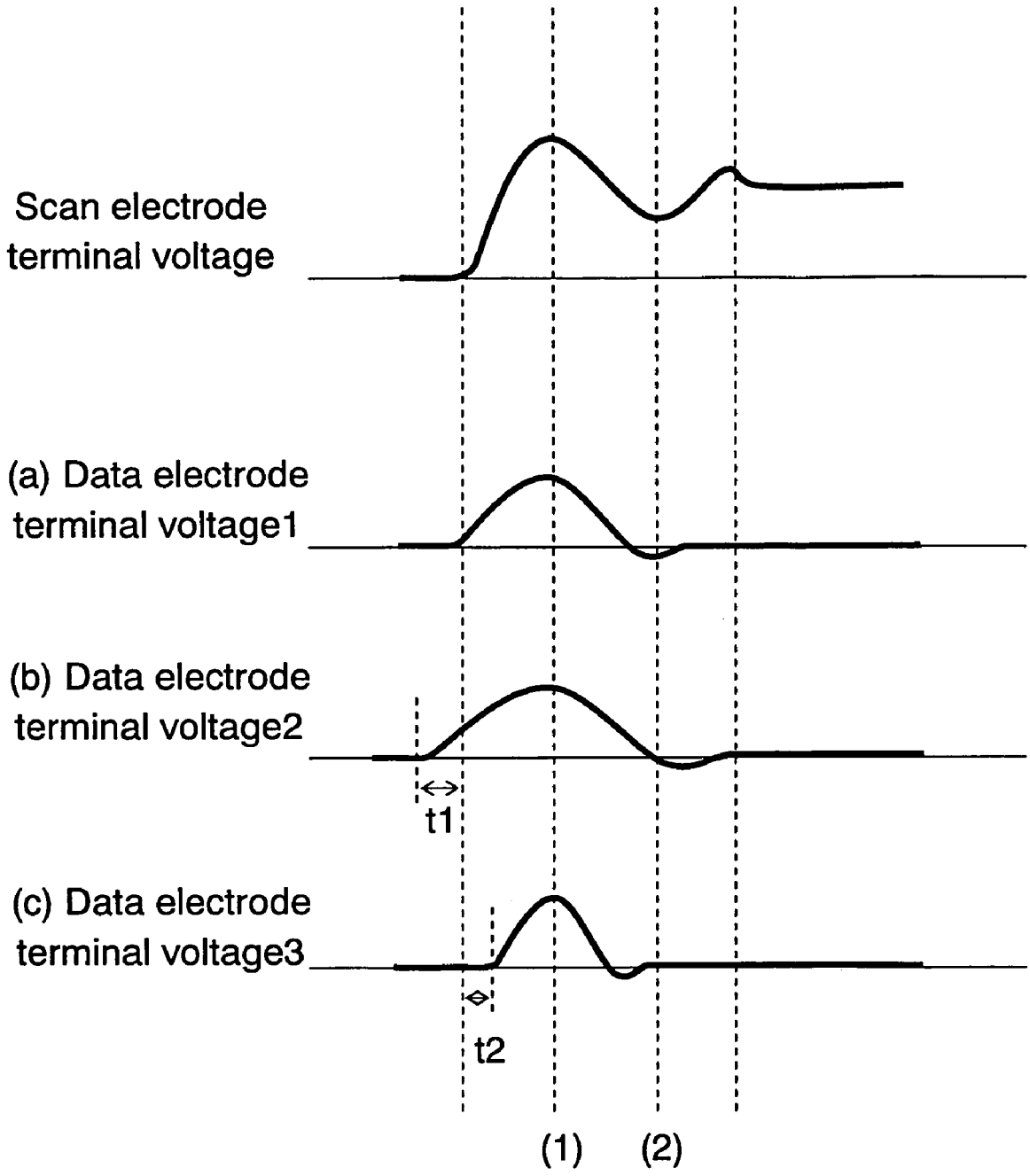
FIG. 5 shows enlarged waveform charts of the aging voltages in the aging method in accordance with the exemplary embodiment.

At timing when the aging voltage waveform applied to scan electrode 5 is reversed by ringing, voltage reversing by the ringing having the same frequency and the same phase is overlaid also on data electrode 10, thereby decreasing potential difference between scan electrode 5 and data electrode 10. As a result, the erasing discharge can be suppressed. FIG. 5 shows enlarged waveform charts of the aging voltages in the aging method in accordance with the exemplary embodiment of the present invention. It is most desirable that frequency (ringing frequency) fd of the ringing waveform included in the aging voltage waveform in data electrode terminal 17, shown by Voltage 1 of FIG. 5(*a*), is equal to frequency (ringing frequency) fsc of that in scan electrode terminal 15. In an AC surface discharge type PDP, generally, electrostatic capacity between scan electrode 5 and sustain electrode 6 is larger than that between the data electrode and the display electrode. Therefore, for synchronizing the ringing of the aging voltage waveform in data electrode terminal 17 with that in scan electrode terminal 15 as shown in FIG. 5(*a*), inductance Ld must be set larger than inductance Lsc as discussed above.

However, even when ringing frequency fd is lower than ringing frequency fsc as shown in Voltage 2 of the data electrode terminal in FIG. 5(*b*) for example, the erasing discharge can be suppressed by matching peak timings with each other by advancing the application timing of rectangular voltage Vd to data electrode terminal 17 by t1. Even when ringing frequency fd is higher than ringing frequency fsc as shown in Voltage 3 of the data electrode terminal in FIG. 5(*c*) for example, the erasing discharge can be suppressed by delaying the application timing of rectangular voltage Vd to data electrode terminal 17 for t2.

When ringing frequency fd is not higher than ½ of ringing frequency fsc, however, potential differences of data electrode terminal 17 at timing (1) and timing (2) are ½ of ringing amplitude or smaller and hence it is less worth using the ringing waveform. When ringing frequency fd is not lower than 2 times higher than ringing frequency fsc, the voltage of data electrode terminal 17 includes one or more cycles of ringing between timing (1) and timing (2). Therefore, whatever the application timing of rectangular voltage Vd is set at, the erasing discharge cannot be suppressed. Values of inductances Lsc, Lss and Ld must be adjusted according to the characteristic of panel 1 so that duration up to the peak of the ringing waveform in data electrode terminal 17 is set in the range of ½ to 2 times that in scan electrode terminal 15.

In the aging method in accordance with the exemplary embodiment of the present invention, only erasing discharge at the timing when voltage of scan electrode 5 is higher than that of sustain electrode 6 is suppressed. This reason is shown below. In an operation of the AC surface discharge type PDP, generally, sustain electrode 6 performs only sustain discharge, but scan electrode 5 performs discharge in writing as well as the sustain discharge. Regarding scan electrode 5, therefore, its entire electrode surface facing data electrode 10 must be aged. In other words, scan electrode 5 and sustain electrode 6 are not equivalently aged, but the aging speed on the scan electrode 5 side is higher than that on the sustain electrode 6 side, thereby allowing efficient aging.

The only erasing discharge at the timing when the voltage of scan electrode 5 is higher than that of sustain electrode 6 is suppressed, thereby emphasizing aging discharge at a next discharge time, namely when the voltage of scan electrode 5 is lower than that of sustain electrode 6. In the discharge at the timing when the voltage of scan electrode 5 is lower, ion spatter on the scan electrode 5 side is performed efficiently, and the aging speed on the scan electrode 5 side is higher than that on the sustain electrode 6 side. Here, the ion spatter is caused by positive ions that travel toward scan electrode 5 in the discharge space.

Figure 6:
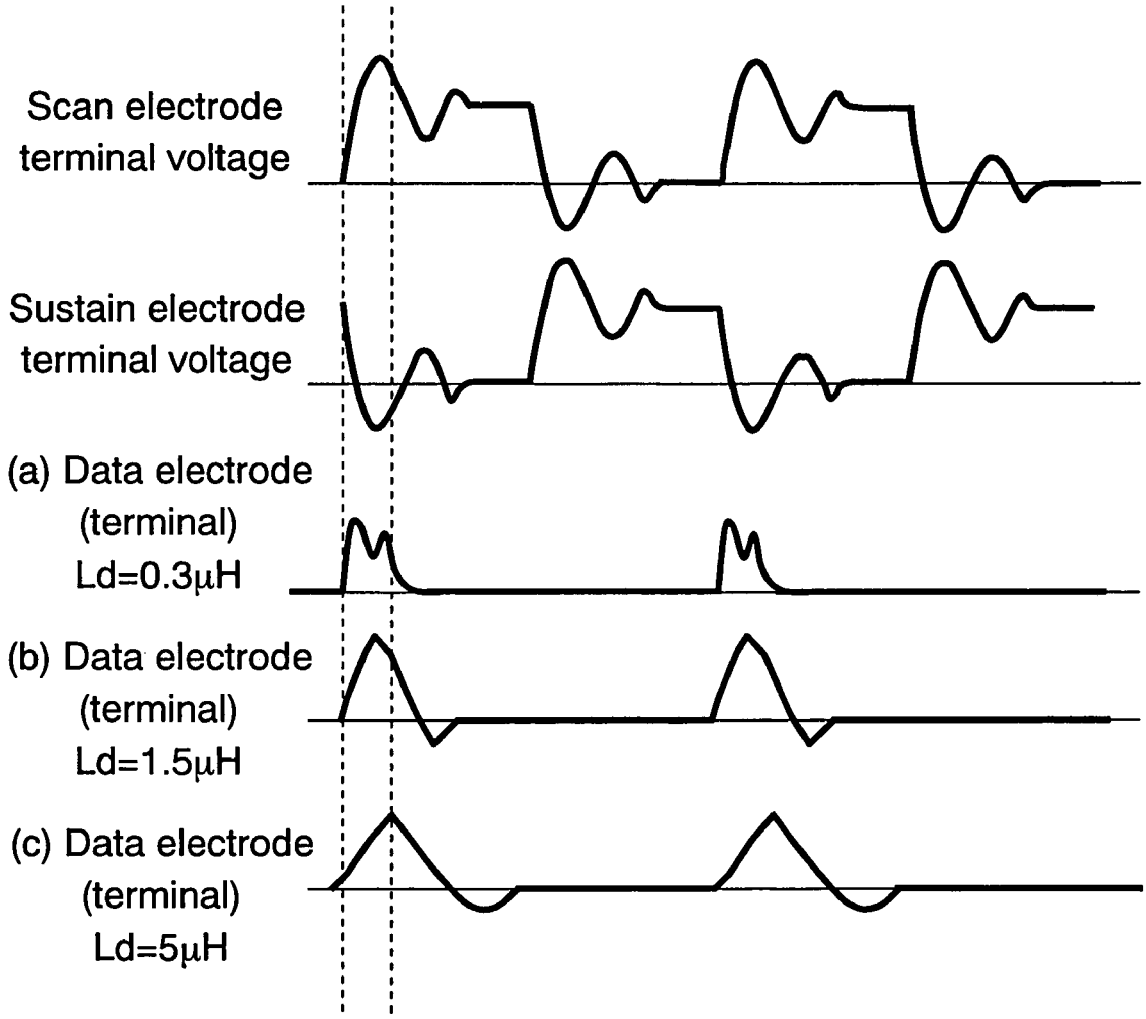
FIG. 6 shows waveform charts of the aging voltages used for an aging experiment in accordance with the exemplary embodiment.

FIG. 6 shows aging voltage waveforms used for an aging experiment. The aging voltage waveforms applied to scan electrode 5 and sustain electrode 6 are similar to those of FIG. 4. Second inductance Lsc between scan electrode terminal 15 and output terminal T2 of the switching element for scan electrodes and third inductance Lss between sustain electrode terminal 16 and output terminal T3 of the switching element for sustain electrodes are set at about 1 μH. First inductance Ld between data electrode terminal 17 and output terminal T1 of the switching element for data electrodes is set at one of three values, 0.3 μH, 1.5 μH and 5 μH. FIG. 6(*a*), (*b*) and (*c*) show aging voltage waveforms in data electrode terminal 17 when first inductance Ld is set at 0.3 μH, 1.5 μH and 5 μH, respectively. In these cases, ringing frequency fd of the aging voltage waveform in data electrode terminal 17 and ringing frequency fsc of the aging voltage waveform in scan electrode terminal 15 satisfy the relations, fd<½ fsc, fd=fsc, and fd>2 fsc. A preferable range of Ld with respect to Lsc and Lss depends on the static capacitances between electrodes of the panel as discussed above, namely design of the panel, and hence cannot be determined. However, it is preferable that Ld lies in a range up to 3 times larger than Lsc or Lss in a general PDP structure.

Inductances Lsc, Lss and Ld can be measured by an inductance-capacitance-resistance (LCR) meter at the same frequency (100 kHz in the present embodiment) in the frequency range of 10 to 500 kHz. The values of Lsc, Lss and Ld depend on the measuring frequency of the LCR meter during measurement. However, not absolute values of the inductances but relative values of them are important in the present invention, so that no problem arises when the inductances are measured under the same condition of the frequency component included in the ringing waveforms, for example.

Figure 7:
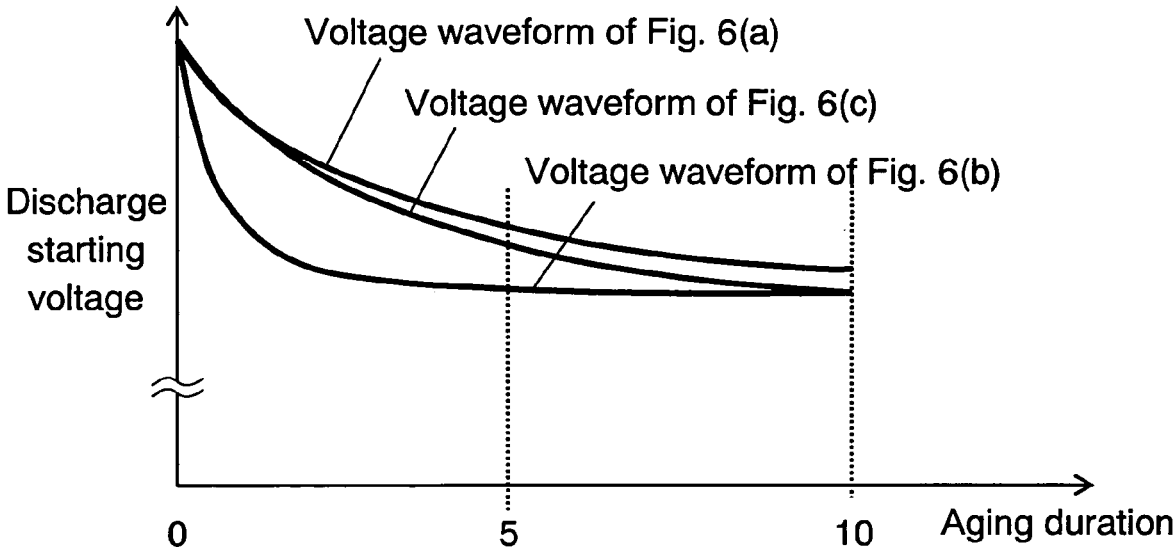
FIG. 7 shows a result of the aging experiment of the aging method in accordance with the exemplary embodiment.

FIG. 7 is a diagram showing a result of the aging experiment of the aging method in accordance with the exemplary embodiment of the present invention. The horizontal axis shows aging duration, and the vertical axis shows discharge starting voltage between scan electrode 5 and sustain electrode 6. At the time when the discharge starting voltage decreases to a predetermined voltage, aging finishes. When the aging voltage waveform of FIG. 6(*a*) or FIG. 6(*c*) is applied to data electrode terminal 17, the aging must be performed for about 10 hours until the discharge starting voltage decreases. When the aging voltage waveform of FIG. 6(*b*) is applied, the discharge starting voltage decreases and stabilizes in about ⅓ of the conventional aging duration.

Inductors 301, 302 and 303 such as coils are used for adjusting first to third inductances in the present embodiment; however, instead of inductors 301, 302 and 303, lengths of lead wires 401, 402 and 403 may be adjusted to provide desired Lsc, Lss and Ld. In the latter case, the first, second, and third inductors are formed of lead wires 401, 402 and 403, respectively. For satisfying Ld>Lsc and Ld>Lss, lead wire 401 is set longer than lead wires 402 and 403 in FIG. 3. The configurations of the first to third inductors may be selected and combined as appropriate. For example, the first inductor is formed of inductor 301 and lead wire 401, the second inductor is formed of lead wire 402, and the third inductor is formed of lead wire 403. FIG. 3 is a schematic diagram to the end, and does not show actual relation among the lengths of lead wires 401, 402 and 403.

The present invention can provide an aging method and an aging apparatus that largely reduce aging duration and have high power efficiency.

INDUSTRIAL APPLICABILITY

The present invention can provide an aging method and an aging apparatus that largely reduce aging duration and have high power efficiency and is useful for an aging method and an aging apparatus in a manufacturing process of an AC type PDP.

The invention claimed is:

1. An aging method of a plasma display panel, wherein the plasma display panel comprises:

a first substrate having a data electrode; and a second substrate that is faced to the first substrate and has a scan electrode and a sustain electrode, the scan electrode and the sustain electrode being formed so as to orthogonally cross the data electrode, and when aging is performed by applying aging voltage to the scan electrode, the sustain electrode, and the data electrode via respective inductors coupled to the electrodes, frequency of a ringing waveform included in an aging voltage waveform applied to the data electrode is set in a range of ½ to 2 times frequency of a ringing waveform included in an aging voltage waveform applied to the scan electrode.

2. An aging method of a plasma display panel according to claim 1, wherein inductance of the inductor coupled to the data electrode is larger than inductance of the inductor coupled to the scan electrode.

3. An aging method of a plasma display panel according to claim 1, wherein the inductor coupled to one of the data electrode and the scan electrode is a lead wire for applying aging voltage to the corresponding electrode.

4. An aging method of a plasma display panel according to claim 1, wherein the inductor coupled to the data electrode includes one of a coil or a ferrite core.

5. An aging method of a plasma display panel according to claim 2, wherein the inductor coupled to one of the data electrode and the scan electrode is a lead wire for applying aging voltage to the corresponding electrode.

6. An aging method of a plasma display panel according to claim 2, wherein the inductor coupled to the data electrode includes one of a coil or a ferrite core.

7. An aging apparatus of a plasma display panel, wherein the plasma display panel comprises:

a first substrate having a data electrode; and a second substrate that is faced to the first substrate and has a scan electrode and a sustain electrode, the scan electrode and the sustain electrode being formed so as to orthogonally cross the data electrode, and when aging is performed by applying aging voltage to the scan electrode, the sustain electrode, and the data electrode via respective inductors coupled to the electrodes, inductance of the inductor coupled to the data electrode is determined so that frequency of a ringing waveform included in an aging voltage waveform applied to the data electrode is set in a range of ½ to 2 times frequency of a ringing waveform included in an aging voltage waveform applied to the scan electrode.

8. An aging apparatus of a plasma display panel according to claim 7, wherein inductance of the inductor coupled to the data electrode is larger than inductance of the inductor coupled to the scan electrode.

9. An aging apparatus of a plasma display panel according to claim 7, wherein the inductor coupled to one of the data electrode and the scan electrode is a lead wire for applying aging voltage to the corresponding electrode.

10. An aging apparatus of a plasma display panel according to claim 7, wherein the inductor coupled to the data electrode includes one of a coil or a ferrite core.

11. An aging apparatus of a plasma display panel according to claim 8, wherein the inductor coupled to one of the data electrode and the scan electrode is a lead wire for applying aging voltage to the corresponding electrode.

12. An aging apparatus of a plasma display panel according to claim 8, wherein the inductor coupled to the data electrode includes one of a coil or a ferrite core.

* * * * *